US005671589A

United States Patent [19]

Irvine et al.

[11] Patent Number: 5,671,589

[45] Date of Patent: Sep. 30, 1997

[54] TAPE PERFORATING HEAD ASSEMBLY AND METHOD

[75] Inventors: Gerald O. Irvine, Tucson, Ariz.; Bobby L. Miller, Jr.; Matthew V. Sundquist, both of Marietta, Ga.

[73] Assignee: Riverwood International Corporation, Atlanta, Ga.

[21] Appl. No.: 608,173

[22] Filed: Feb. 28, 1996

[51] Int. Cl.[6] ..... B65B 61/18

[52] U.S. Cl. ..... 53/412; 53/133.8; 53/136.4

[58] Field of Search ..... 83/331, 343, 371, 83/549, 660, 674; 53/412, 415, 416, 133.3, 133.5, 133.6, 133.8, 135.1, 136.1, 136.4, 137.2

[56] References Cited

U.S. PATENT DOCUMENTS

| | | | |
|---|---|---|---|
| 3,463,039 | 8/1969 | Silver | 83/660 |
| 3,942,631 | 3/1976 | Sutherland et al. | 53/412 |
| 4,143,568 | 3/1979 | Cogswell | 83/116 |
| 4,444,080 | 4/1984 | Schulz | 83/660 |
| 4,467,687 | 8/1984 | Fokos et al. | 83/674 |
| 4,586,312 | 5/1986 | Limousin | 53/412 |
| 4,635,316 | 1/1987 | Towne et al. | 83/660 |
| 4,951,967 | 8/1990 | Michalik | 83/660 |
| 5,224,408 | 7/1993 | Steidinger | 83/674 |
| 5,423,161 | 6/1995 | Huson et al. | 53/133.8 |
| 5,480,371 | 1/1996 | Morita et al. | 53/136.4 |

*Primary Examiner*—Daniel Moon
*Assistant Examiner*—Ed Tolan

[57] ABSTRACT

A tape perforating head assembly for scoring a perforated tear line in a piece of packaging tape joining article carriers together includes a headpiece, a plurality of perforating blades supported on the headpiece parallel to and adjacent one another, each perforating blade having a series of serrated teeth constructed and arranged to score the perforated tear line in the packaging tape. Each perforating blade is supported on the headpiece for reciprocal movement with respect to one another into a normally extended position away from the headpiece, and into a retracted position on the headpiece. The tape perforating head assembly also includes a spring positioned within a bore in which a guide pin is received, a pair of guide pins, and a pair of bores being provided for each perforating blade. The tape perforating head assembly scores a perforated tear line in the packaging tape by moving the headpiece in timed relationship with the movement of the carrier along a path of travel extending through a packaging machine, moving the perforating blades into contact with the packaging tape, and scoring the perforated tear line in the packaging tape with at least one of the perforating blades as the carriers move along the path of travel.

15 Claims, 4 Drawing Sheets

TAPE PERFORATING HEAD ASSEMBLY AND METHOD

FIELD OF THE INVENTION

This invention relates in general to packaging machinery. More particularly, this invention relates to an improved tape perforating head assembly for scoring a perforated tear line into packaging tape used to hold adjacent packages of articles together. The present invention also provides an improved method of scoring the perforated tear line in the packaging tape as the carriers of prepackaged articles are moved along a path of travel through a packaging machine.

BACKGROUND OF THE INVENTION

In modem packaging operations, pluralities of articles often are prepackaged or otherwise grouped together and moved along a path of travel through a packaging machine and/or packaging line. For example, one known method of prepackaging articles is to enclose them within paperboard carton blanks formed into paperboard carriers. The paperboard carrier not only groups a predetermined number of articles together, but it also serves as a carrier for article shipment, as well as a carrier for the packaged goods by the product end consumer. Paperboard carriers also are used to display advertisements on their outer side panels.

In the U.S. beverage industry, a standard case of beverage containers has long been considered to be twenty-four beverage containers, i.e., bottles or cans. Although there are paperboard carriers that can hold a case of beverages, paperboard carriers holding prepackaged four-packs, six-packs and twelve-packs have arisen in response to consumer demand. A number of the product handling systems used in packaging operations, for example, palletizing operations, however, are based upon a traditional case of beverages in which cases of twenty-four beverage containers are placed adjacent one another, and stacked in layers on a pallet, the entire palletized load then being wrapped or bound together and then shipped to wholesalers, distributors, and/or retailers.

In order to fit existing packaging machinery for smaller groups of prepackaged articles with case sized palletizing machines, the packaging industry has grouped four-packs, six-packs and/or twelve-packs into a traditional case-size lot by taping the smaller groups of articles together into a single package of articles having the shape and size of a traditional case of beverages. This is routinely done by applying packaging tape across opposed sides, typically the top and bottom, of the paperboard carriers. Although this results in greater efficiency in the post-packaging handling of the articles, especially during palletizing of the carriers, problems arise in breaking the separate carriers apart when the carriers are being shelved for display and sale at retail outlets.

In order to make it easier to break bulk, i.e., break the case-size lot of beverage containers into its component four-pack, six-pack, or twelve pack size, a perforated tear line is scored in the packaging tape, preferably between the adjacent carriers forming the case of product. This has been accomplished by moving a tape perforating head against the tape and in timed relationship with the movement of the carriers moving along the path of travel through the packaging machine or on the packaging line.

Known tape perforating heads have a single perforating blade held in a fixed position on a rotating hub so that the blade strikes the packaging tape, hopefully between the adjacent carriers, to score the perforated tear line. Due to the high speed at which modem packaging machines operate, however, as well as the inherent inability to move large numbers of relatively bulky carriers with a great deal of precision, the problem has arisen that the known tape perforating heads will often score the tear line in the packaging tape on top of the paperboard carriers, rather than scoring the perforated tear line only in the tape between the carriers. The result is that when the case lot of prepackaged articles of product manually are broken apart into their component packages at a retail outlet, the packaging tape will often tear or damage the paperboard carrier, resulting in damage to articles should they fall out of the paperboard carriers, or the return of the damaged paperboard carriers along with potentially loose articles of product to the distributor for repackaging or return to the manufacturer/packager of the product. Additionally, such undersized tearing tends to damage the advertising or the outer side of the carriers.

Therefore, the need exists for a tape perforating head assembly and method which will consistently score a perforated tear line in the packaging tape between adjacent prepackaged articles of product, thus lessening the chance of damage to paperboard carriers and packaged articles as the carriers are broken apart from one another.

SUMMARY OF THE INVENTION

The improved tape perforating head assembly of this invention includes a headpiece having a plurality of adjacently positioned perforating blades, each blade having a series of serrated teeth constructed and arranged to score a perforated tear line, the blades being supported on the headpiece parallel to and adjacent one another. The perforating blades are constructed and arranged to be reciprocally moved with respect to one another on the headpiece into a normally extended position extending away from the headpiece, and into a retracted position on the headpiece. The apparatus also includes a biasing means such as a helical spring or other suitable resilient spring-type element, for separately urging each perforating blade into its normally extended position.

Each of the perforating blades has a pair of spaced and elongated slots formed therein, the elongated slots within each perforating blade aligning with the slots in each other adjacently disposed perforating blade as the blades are received on the headpiece. A pair of shoulder bolts are passed through each slotted opening within the perforating blades, and are threadedly received within the headpiece for allowing the reciprocal movement of the perforating blades on the headpiece. Each perforating blade also includes a pair of lateral wing portions formed along at least a portion of the length of the perforating blade, and extending away from the blade. Each wing portion has a guide pin formed thereon, the guide pins being spaced apart and generally parallel to one another. The guide pins of each perforating blade are received one each within a pair of spaced and generally parallel bores formed in the headpiece, into which the helical spring is placed before inserting the guide pin into the bore. The springs act against the wing portion to urge each perforating blade outwardly, into its normally extended position on the headpiece.

The novel method of this invention provides for the scoring of a perforated tear line in a piece of packaging tape placed across at least two adjacent article carriers formed into a single package being moved along a longitudinal path of travel, by positioning a headpiece having a plurality of perforating blades adjacent the path of travel, moving the headpiece in timed relationship with the movement of the carriers along the path of travel, moving the perforating blades into contact with the packaging tape, and scoring the perforated tear line in the packaging tape with at least one of the adjacent perforating blades. The remaining perforating blades which do not form the score line in the packaging tape between the adjacent carriers are moved into a retracted position on the headpiece in response to striking the paperboard carriers of the prepackaged articles of product, so that the serrated teeth of the perforating blades do not cut through or otherwise damage the paperboard carriers or the articles contained therein.

Both the apparatus and method of the invention may include positioning two generally identical tape perforating head assemblies on opposite sides of the carriers being moved along the path of travel, for scoring a perforated tear line on opposed sides, or surfaces, of the packaging tape applied to the carriers.

Although reference is made to use of this apparatus and method for forming a perforated tear line between paperboard carriers for beverage containers, the apparatus and method of this invention are ideally suited for use with carriers of any size and shape which are placed adjacently to form a consolidated grouping, or case, of prepackaged articles.

DETAILED DESCRIPTION OF THE DRAWINGS

DETAILED DESCRIPTION OF THE PREFERRED EMBODIMENT

Figure 1:
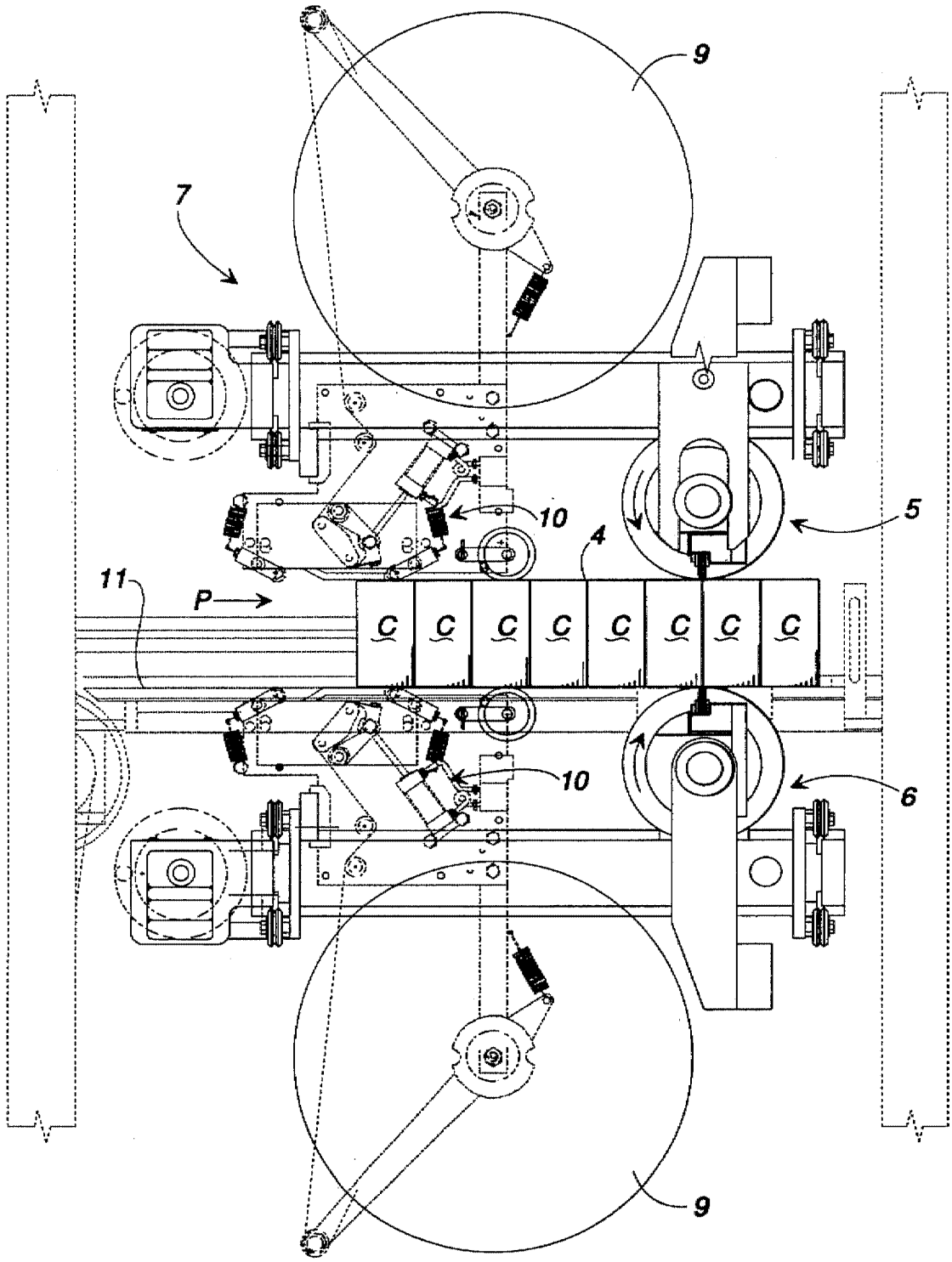
FIG. 1 is a side elevational view of a packaging machine illustrating a spaced and opposed pair of the preferred embodiment of the perforating head assemblies positioned adjacent a path of travel extending through the packaging machine.

Referring now to the drawings, in which like reference characters indicate like parts throughout the several views, numerals 5 and 6 are each an identical preferred embodiment of a tape perforating head assembly of the this invention. Thus, as shown in FIG. 1, tape perforating head assemblies 5 and 6 are identical, although in opposite hand with respect to the other, each being positioned on opposite sides, i.e. in this example, the top and bottom, of the longitudinal path of travel P extending through a tape application assembly 7 of a conventional, continuous motion packaging machine (not shown). Tape application assembly 7 includes a pair of tape dispenser assemblies 10 positioned above and below the path of travel for applying pieces of packaging tape T (FIGS. 7A–7D) to the top and bottom sides of a predetermined number of, e.g. paperboard carriers, C being moved along the path of travel on surface conveyor 11. Tape application assembly 7 may comprise any one of the taping machines of the type known in the art, to include the Tapematic brand of assemblies manufactured and sold by Riverwood International Corporation of Atlanta, Ga.

Figure 2:
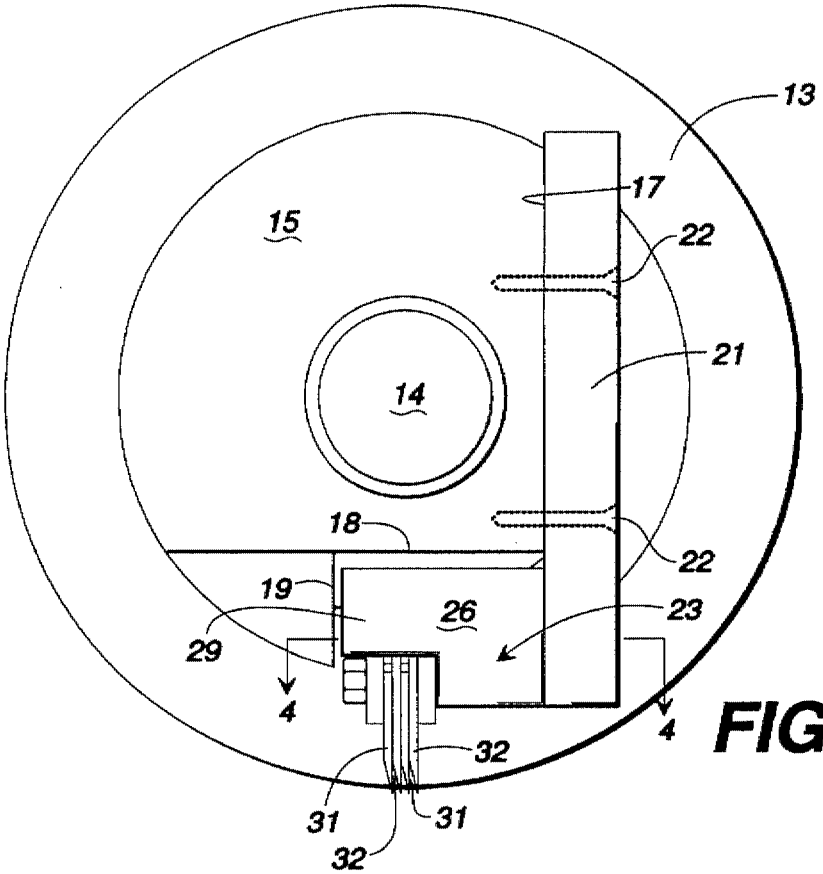
FIG. 2 is a side elevational view of a preferred embodiment of a tape perforating head assembly.
Figure 3:
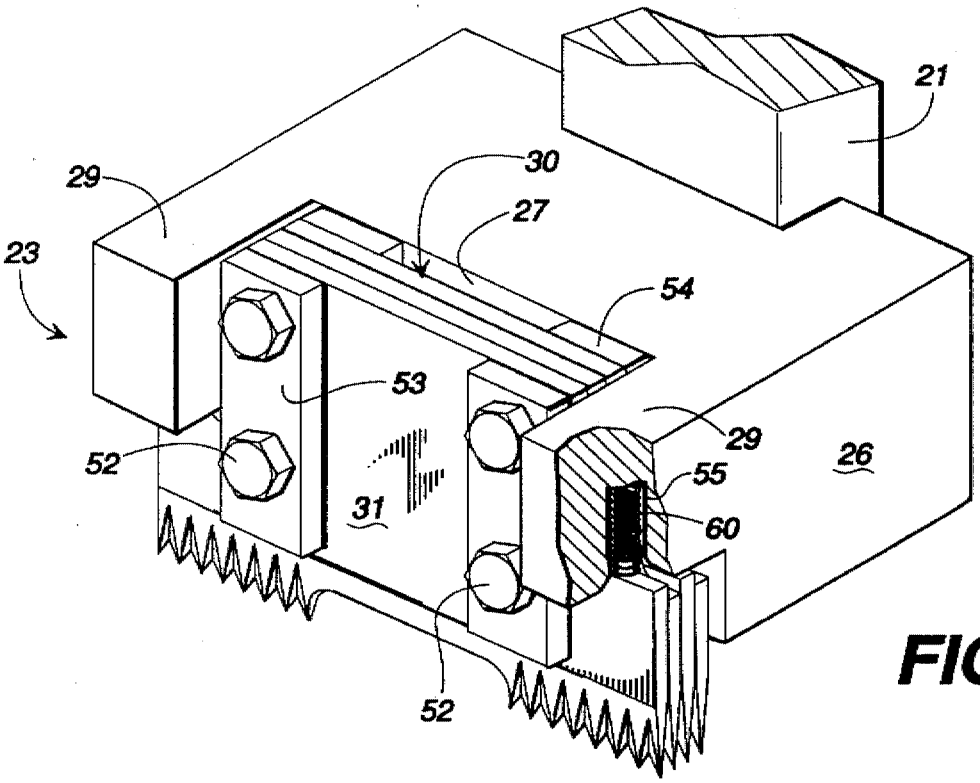
FIG. 3 is a partially cutaway perspective view of the tape perforating head assembly of FIG. 2.
Figure 4:
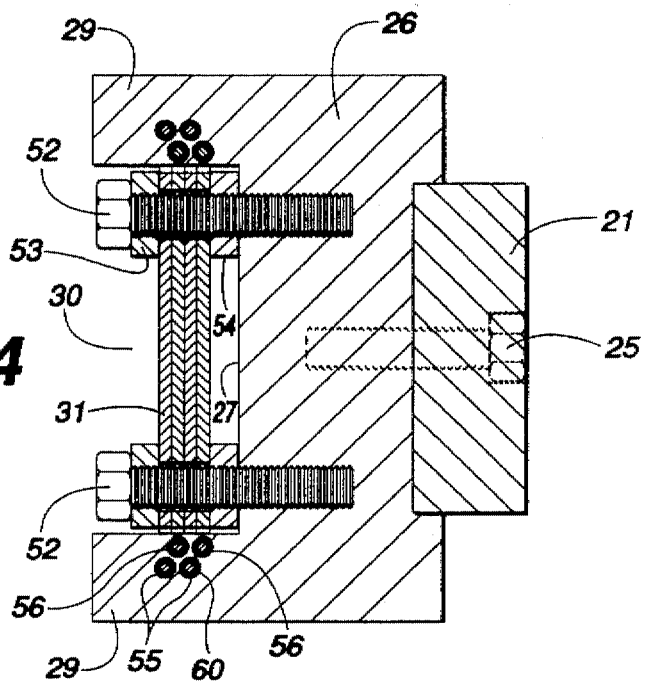
FIG. 4 is a cross-sectioned top plan view along line 4—4 of FIG. 2.

As perforating head assemblies 5 and 6 are identical, only tape perforating head assembly 5 need be discussed in greater detail, and is illustrated in FIGS. 2 through 4. Referring first to FIG. 2, tape perforating head assembly 5 includes a generally circular hub 13 constructed and arranged for rotation about an axial shaft 14, the axial shaft being conventionally supported and powered for movement on tape application assembly 7. Hub 13 includes a raised hub 5 concentrically mounted or formed thereon, the raised hub 15 having a first machined surface 17, a generally perpendicular second machined surface 18, and a third machined surface 19, generally perpendicular to the second machined surface. Raised hub 15 receives a mounting bar 21 having a pair of threaded mounting screws 22 passed therethrough and into first machined surface 17. The end of mounting bar 21 adjacent to second machined surface 18 has a head assembly 23 secured thereto by a threaded mounting screw 25 (FIG. 4). Head assembly 23 fits within the space defined by second machined surface 18 and third machined surface 19 of the rotating hub, but is not in contact with those machined surfaces. So constructed, the head assembly 23 is securely positioned on hub 13 and axial shaft 14, and is positioned thereon with respect to the carriers C moved along path of travel P, as shown in FIG. 1.

As best shown in FIG. 4, headpiece 26 of the head assembly 23 has an end wall 27 from which a pair of generally parallel projections 29 extend perpendicularly away. Projections 29 form a channel 30 therebetween, as shown in FIGS. 3 and 4. A plurality of perforating blades 31, 32 are held within channel 30, blades 31, 32 being constructed for reciprocal movement with respect to one another toward and away from headpiece 26. Blades 31 and 32 alternate with one another in series within channel 30 of the headpiece assembly 23, as best shown in FIGS. 2 and 3. Each of blades 31, 32 are parallel to, and adjacent one another within channel 30.

Figure 5:
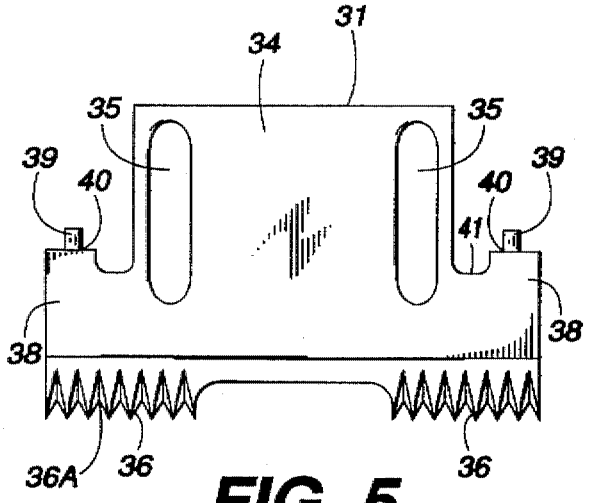
FIG. 5 is a front elevational view of a first perforating blade.
Figure 6:
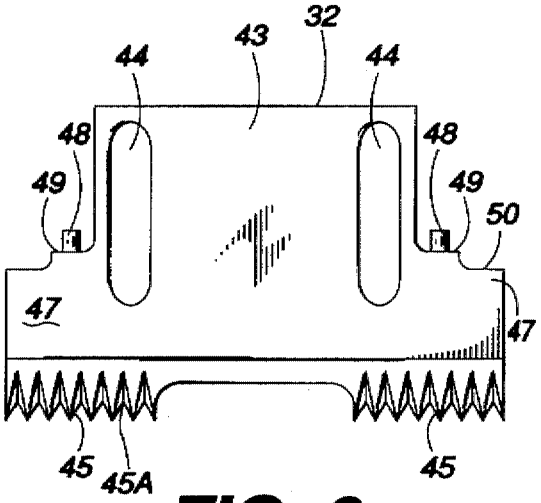
FIG. 6 is a front elevational view of a second perforating blade.

Blades 31 and 32 are best shown in FIGS. 5 and 6, respectively. Perforating blade 31, illustrated in FIG. 5, has a planar body 34 in which a pair of spaced and parallel slotted openings 35 are formed along the length of body 34. A series of serrated teeth 36 are provided at the bottom edge of body 34. Defined between adjacent teeth 36 are V-shaped cutting surfaces 36A. Although these serrated teeth preferably are provided in two spaced series of serrated teeth as shown in FIGS. 5 and 6, the bottom edges on both blades 31 and 32 may have a single continuous row of serrated teeth. Still referring to perforating blade 31 of FIG. 5, a pair of opposed wing portions 38 extend laterally away from body 34, in the plane of the body, and extend along at least a portion of the length of the body. An upstanding guide pin 39 is formed on each of wing portions 38, each guide pin 39 being spaced from and parallel to the other. A shoulder 40 is formed about each of pins 39 where the guide pin extends away from wing portion 38, forming a bearing surface thereon. Perforating blade 31 of FIG. 5 also includes an arcuate notch 41 defined between body 34 and along the top edge of wing potion 38 so that blade 31 will not strike helical springs 60 (FIG. 4) received on pins 48 of blades 32 (FIG. 6) as blade 31 reciprocates within channel 30 on headpiece 26.

Perforating blade 32 is shown in FIG. 6. Perforating blade 32 is similar to perforating blade 31 of FIG. 5, and has a planar body 43 in which a pair of spaced, parallel and elongated slotted openings 44 are formed. Perforating blade 32 includes two spaced series of serrated teeth 45 at the bottom edge of the body, and a pair of wing portions 47 extending laterally away therefrom and in the plane of body 43. A single row of teeth 45 also will perform satisfactorily. Defined between adjacent teeth 45 are V-shaped cutting surfaces 45A. An upwardly extending guide pin 48 is formed on each wing portion 47, each guide pin 48 being spaced from and parallel to the other as are guide pins 39 on perforating blade 31. Guide pins 48, however, are spaced more closely to one another than are guide pins 39 of perforating blade 31. A shoulder 49 is formed about each guide pin 48 where it joins wing potion 47. Perforating blade 32 also includes an arcuate corner notch or shoulder 50 formed at the outside corner of each wing portion 47 so that perforating blade 32 will not strike helical springs 60 for adjacent perforating blade or blades 31 as blade 32 reciprocates within channel 30 on headpiece 26.

Although four blades 31, 32 are shown on headpiece 26 in FIGS. 2–4, it is anticipated that a greater or lesser number of blades may also be used based on the size and speed of the prepackaged articles of product during the path of travel. It is anticipated, however, that a minimum of two blades, a blade 31 and a blade 32, will be provided as pan of head assembly 23. Further, blades 31 and 32 could define a continuous cutting surface, rather than the serrated teeth shown for illustration of the preferred embodiment.

Returning now to FIGS. 3 and 4, perforating blades 31 and 32 are spaced in alternating series parallel to and adjacent one another within channel 30 so that each pair of slotted openings 35 and 44 within each perforating blade align with one another. Two pairs of shoulder bolts 52, one pair for each series of aligned slotted openings within blades 31, 32, is first passed through a first spacer bar 53, through slotted openings 35 and 44, respectively, and through a second spacer bar 54 to be threadedly received within headpiece 26. Shoulder bolts 53 do not compress the blades to restrict their movement toward and away from hub 14, but act as the guides, or as guide pins, on which perforating blades 31, 32 reciprocate freely within channel 30, the travel of each perforating blade being defined by the length of slotted openings 35, 44 defined therein.

Guide pins 39 of perforating blade 31 are received within a first pair of outer bores 55 (FIG. 4) defined within projections 29, one bore of first pair of bores 55 being defined within each one of projections 29. In similar fashion, guide pins 48 of perforating blade 32 are received one each within a second pair of inner bores 56 (FIG. 4) also defined one each within each of projections 29 of headpiece 26. Each of bores 55, 56 are formed in projections 29 to receive pins 39 and 48 therein with a relatively close tolerance, but yet to allow each of the pins to move freely within the bores so as to not impede the reciprocal movement of perforating blades 31, 32 toward and away from hub 14. A helical spring 60 is received within each one of bores 55, 56. Helical spring 60, as best shown in FIG. 3, is confined with each of bores 55, 56, and extends downward over pin 39 or pin 48, depending on which of perforating blades 31, 32 the respective spring contacts. Helical spring 60 is chosen so that it will have just a sufficient force to bias blades 31 and 32 away from headpiece 26 into their normally extended position, but is not so rigid that if blades 31 or 32 strike either of the paperboard carriers that the blades will perforate either the paperboard carrier or the packaging tape thereon. If, however, the blade strikes the packaging tape extending between the paperboard carriers, the helical spring will hold the perforating blade in place so that a perforated score line is formed in the packaging tape. The spring force should be selected so that in operation, the blades will score the tape but will not puncture the carrier.

In lieu of helical spring 60, a resilient rubber-type element or other suitable biasing means can be inserted into bores 55, 56 against which pins 39, 48 would act directly. The advantage of providing a rubber/engineering polymer spring-type member would be to prevent the introduction of dirt or trapped particles within bores 55, 56. Springs 60 bias each of perforating blades 31, 32 into its normally extended position, as shown generally in FIGS. 7A, 71B, and 7D.

Tape perforating head assembly 5 may be constructed of any conventional material, providing structural rigidity, durability, and resistance to potentially corrosive handling environments. It is anticipated, however, that tape perforating head assembly 5 will be constructed of either stainless steel or a suitable high strength carbon-based steel allowed for use in food or beverage handling environments under the applicable national and/or local food handling and/or food packaging laws.

A feature of tape perforating head assembly 5, as disclosed, is that individual perforating blades 31, 32, can be readily replaced with a minimal mount of machine downtime in the event that a perforating blade becomes dulled over time, or otherwise becomes chipped or damaged.

OPERATION

A unique feature of the tape perforating head assemblies 5 and 6 disclosed in FIGS. 1 through 6 is the ability to consistently score a perforated tear line in packaging tape T between adjacent article carriers C, as illustrated generally in FIGS. 7A through 7D.

Figure 7A:
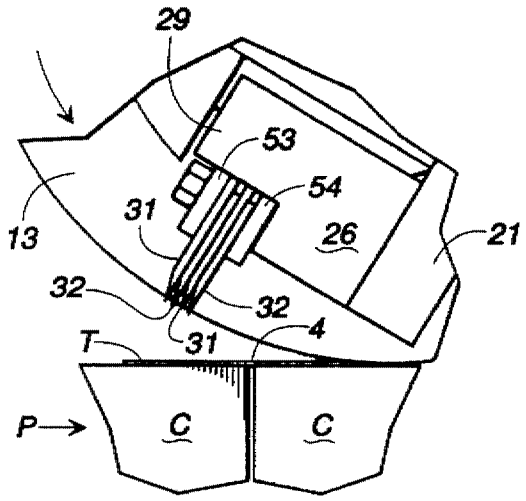
FIGS. 7A through 7D are sequential and partially cut away views of the preferred embodiment of the tape perforating head assembly scoring a perforated tear line in the packaging tape extending between two adjacent carriers.

Referring fast to FIG. 7A, a pair of adjacent article carriers C are shown moving along a path of travel P through a tape applicator assembly 7 of a packaging machine (not shown). Tape perforating head assembly 5 is placed adjacent the path of travel P, and positioned with respect to the carriers C, as illustrated generally in FIG. 1. Thus, and as shown in FIG. 7A, a portion of hub 13 of the tape perforating head assembly is shown rotating in the direction of the path of travel so that perforating blades 31, 32 are being moved toward packaging tape T, and in particular toward the packaging tape extending over the gap which is present between the adjacent carriers, so that the perforated tear line will be scored in the packaging tape without significantly damaging the paperboard carriers in which the articles are packaged. As shown in FIG. 7A, each of perforating blades 31 and 32 is shown in its normally extended position, in which the blades extend away from headpiece 26.

Figure 7B:
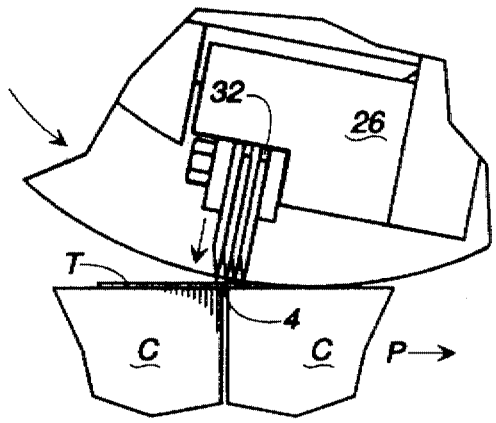
Figure 7C:
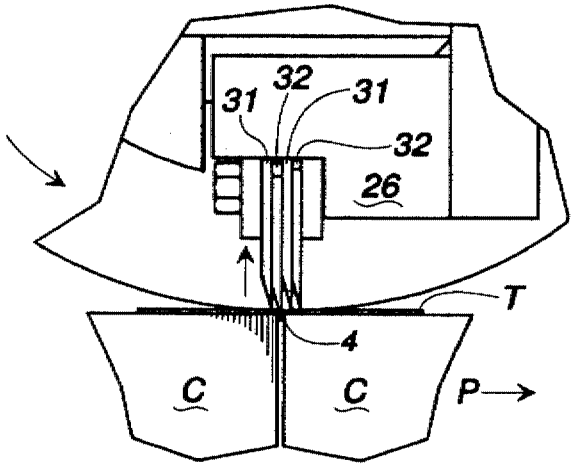

In FIG. 7B, the first perforating blade in series, here blade 32, is just touching packaging tape T as the carrier C and head assembly 23 are moving along the path of travel. At this point, all perforating blades 31 and 32 are still in their extended position, extending away from headpiece 26. As shown in FIG. 7C, however, as tape perforating head assembly 5 and carrier C continue to move along the path of travel, one of the perforating blades, in this instance, the second perforating blade 32, remains biased in its extended position by spring 60 so that it is extended into, and scores a perforated tear line in, packaging tape T extending over and between adjacent carriers C. The remaining perforated blades, the first perforating blade 32, and the two perforating blades 31, however, have been moved into their retracted position toward headpiece 26 by their contact with carriers C, compressing springs 60 within bores 55, 56 (not shown), so that these perforating blades will not score a perforated line through the paperboard carriers moving along the path of travel.

It should be understood that the use of a plurality of blades reduces the necessity to precisely time the passing of the adjacent carriers directly below the bottom dead center position of assembly 7. In other words, since more blades are used, a larger "window" is created in which assembly 7 can cause a blade to hit the line 4 directly between adjacent carriers C. By providing four parallel and adjacent perforating blades 31, 32, the improved tape perforating head assembly of this invention allows for the scoring of a perforated tear line in the packaging tape between the articles of product in almost every instance, as opposed to the perforating head assemblies of the prior art in which only a single perforating blade is provided which, because of timing problems, frequently does not score a perforated tear line in the packaging tape at the line 4 between the adjacent prepackaged carriers C. Thus, the preferred embodiment of tape perforating head assembly 5, illustrated in FIGS. 7A through 7D provides a more reliable apparatus, and method, of scoring a perforated tear line in the packaging tape between the carriers to insure that the carriers are not damaged when the carriers are later broken apart, i.e., separated into their smaller prepackaged size, for display and sale.

Figure 7D:
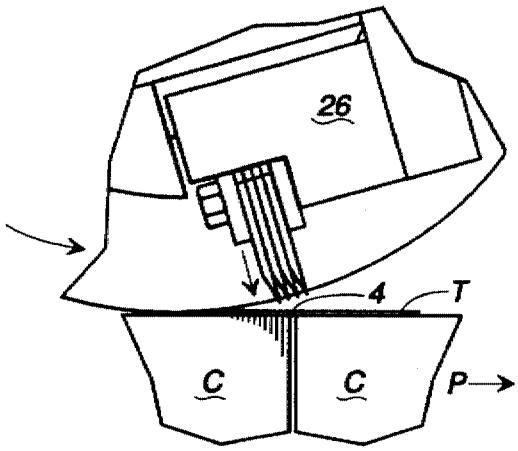

In FIG. 7D, perforating blades 31 and 32 are once again in their fully extended position, as none of the blades are in contact with either packaging tape T, or carriers C, both the perforating head assembly and the carriers moving in the direction of the path of travel after the perforated tear line (not illustrated) has been scored in the packaging tape. Each blade 31, 32 is once again in its fully extended position.

As shown generally in FIG. 1, a tape perforating head assembly 5 and a tape perforating head assembly 6 may be provided on each side of path of travel P along which the prepackaged articles of product travel, to score a perforated tear line in the packaging tape on each side of combined. Thus, as perforating head assembly 5 of FIGS. 7A through 7D is scoring a perforated tear line in the top side of carriers C for example, tape perforating assembly 6 of FIG. 1 is forming a second perforated tear line in the bottom side of the carriers C.

Moreover, although a single head assembly 23 is shown on each of tape perforating head assemblies 5 and 6 of FIG. 1, greater numbers of head assemblies 23 can be provided on each hub 13 based upon the packaging requirements of the applicable packager or packaging operations undertaken. Each of hubs 13 can be powered in timed relationship with surface conveyor 11 as the prepackaged articles of product move thereon by a conventional mechanical drive, or by a digital servo drive, if so desired. It is anticipated that the rotational speed of each tape perforating head assembly 5, 6 will be matched to the speed, and size, of the prepackaged articles of product being moved along the path of travel through the packaging machine in known fashion so that a blade will strike the exact line 4 between adjacent carriers C.

While a preferred embodiment of the invention has been disclosed in the foregoing specification, it is understood by those skilled in the art that variations and modifications thereof can be made thereof without departing from the spirit and scope of the invention, as set forth in the following claims. Moreover, the corresponding structures, materials, acts, and equivalents of all means or step-plus-function elements and the claimed elements are intended to include any structure, material, or acts, for performing the functions in combination with out claimed elements as specifically claimed below.

We claim:

1. A tape perforating head assembly for scoring a perforated tear line in a piece of packaging tape used to join adjacent article carriers together, the article carriers being moved along a path of travel through a packaging machine, said tape perforating head assembly comprising:

a headpiece;

a plurality of perforating blades, each said perforating blade being supported on said headpiece parallel to and in slidable engagement with adjacent ones of said perforating blades for reciprocal movement with respect to one another, each of said plurality of blades extending away from said headpiece in a normally extended position; and biasing means carried on said headpiece and disposed adjacent said plurality of blades for urging each of said plurality of perforating blades independently of one another into said normally extended position, said biasing means being constructed and arranged to yield inwardly of said headpiece for independently allowing separate ones of said plurality of blades to be moved out of said normally extended position in response to striking one of the article carriers.

2. The tape perforating head assembly of claim 1, further comprising means for moving said tape perforating head assembly in timed relationship with the movement of the article carriers along the path of travel through the packaging machine.

3. The tape perforating head assembly of claim 1, wherein said headpiece defines a pair of spaced and generally parallel bores for each respective one of said plurality of perforating blades, and wherein each blade of said plurality of blades has a pair of spaced guide pins formed thereon, wherein one guide pin of each of said pairs of guides pin extends at least partially into one of said bores of each said pair of bores, respectively.

4. The tape perforating head assembly of claim 3, wherein each said pair of bores for each of said perforating blades is offset with respect to each adjacent said pair of bores for adjacent ones of said plurality of blades on said headpiece.

5. The tape perforating head assembly of claim 3, each of said plurality of perforating blades including a shoulder formed generally about each of said guide pins, wherein said means for biasing said perforating blades comprises a spring received within each respective one of said bores and bearing against each said shoulder, respectively, for each said perforating blade.

6. The tape perforating head assembly of claim 3, each of said plurality of perforating blades defining a pair of slotted openings therein, said pairs of slotted openings being aligned with one another in each of the perforating blades, and a spaced pair of shoulder bolts passed through each of said slotted openings in each said perforating blade and into said headpiece for mounting said perforating blades for reciprocal movement on said headpiece.

7. The tape perforating head assembly of claim 6, each of said plurality of perforating blades comprising a generally rectangular and planar body having a length, said pair of slotted openings being defined along the length of said body, and a pair of opposed, generally rectangular, and planar wing portions formed along at least a portion of the length of said body and extending away therefrom in the plane of the body, one each of said guide pins of said pair of guide pins being formed on each said wing portion, respectively, and projecting along the length of said body.

8. The tape perforating head assembly of claim 1, wherein each respective one of said plurality said blades includes two spaced series of serrated teeth.

9. The tape perforating head assembly of claim 1, wherein said plurality of perforating blades comprises four perforating blades.

10. The tape perforating head assembly of claim 1, wherein said headpiece comprises:

a body portion having an end wall; and a pair of spaced, parallel, and generally elongated projections extending in a generally perpendicular direction away from said end wall and defining a channel therebetween extending along at least a portion of said end wall;

wherein said plurality of blades is at least partially received within said channel.

11. A method of scoring a tear line in a piece of packaging tape placed across at least two adjacent carriers formed into a single package and being moved along a path of travel through a packaging machine, said method comprising the steps of:

positioning a headpiece, the headpiece having a plurality of parallel perforating blades reciprocably supported thereon, adjacent the path of travel;

independently biasing each of said plurality of blades away from said headpiece into a normally extended position with respect to said headpiece;

moving said headpiece in timed relationship with the movement of the carriers along the path of travel;

moving said plurality of perforating blades into contact with the packaging tape holding the adjacent carriers together;

independently moving separate ones of said plurality of blades inwardly of said headpiece and out of said normally extended position in response to striking the article carriers; and scoring the perforated tear line in the packaging tape extending between the at least two carriers with one of said plurality of perforating blades.

12. A method of scoring a perforated tear line in a first piece of packaging tape extended across a first side, and in a second piece of packaging tape extended across a spaced second side, respectively, of a predetermined number of adjacent article carriers formed into a single package and being moved along a path of travel through a packaging machine, said method comprising the steps of:

positioning a first headpiece, said first headpiece having a first plurality of parallel perforating blades reciprocably supported thereon, adjacent the path of travel;

independently biasing each one of said first plurality of perforating blades into an extended position with respect to said headpiece;

moving said first headpiece in timed relationship with the movement of the carriers along the path of travel;

engaging the first piece of packaging tape extending across the first side of the article carriers with said first plurality of perforating blades;

scoring the perforated tear line in the first piece of packaging tape on the first side of the carriers with one of said first plurality of perforating blades; and independently urging the other ones of said first plurality of perforating blades inwardly of said first headpiece in response to striking the first sides of the article carriers.

13. The method of claim 12, further comprising the steps of:

positioning a second headpiece, said second headpiece having a second plurality of parallel perforating blades reciprocably supported thereon, adjacent the path of travel;

independently biasing each one of said second plurality of perforating blades into an extended position with respect to said second headpiece;

moving said second headpiece in timed relationship with the movement of the carriers along the path of travel;

engaging the second piece of packaging tape extending across the second side of the carriers with said second plurality of perforating blades; and scoring the perforated tear line in the second piece of packaging tape on the second side of the carriers with one of said second plurality of perforating blades; and independently urging the other ones of said second plurality of perforating blades inwardly of said headpiece in response to striking the second sides of the article carriers.

14. A method of taping a series of article carriers together into a single package, and of scoring a perforated tear line in a packaging tape used to hold the carriers together, on a packaging machine, said method comprising the steps of:

moving the series of article carriers along a path of travel through the packaging machine;

positioning at least two of the carriers adjacent one another along the path of travel;

applying at least one piece of packaging tape across the sides of the at least two carriers and holding the at least two carriers together in response thereto;

positioning at least one headpiece, the headpiece having a plurality of parallel perforating blades reciprocably supported thereon, adjacent the path of travel;

moving said at least one headpiece in timed relationship with the movement of the at least two carriers along the path of travel;

engaging said at least one piece of packaging tape with said plurality of perforating blades;

scoring the perforated tear line in said at least one piece of packaging tape between the at least two article carriers with one of said plurality of perforating blades in response thereto; and independently moving the others of said plurality of perforating blades inwardly of said headpiece in response to striking the respective sides of the at least two carriers.

15. The method of claim 14, further comprising the step of biasing each of said plurality of perforating blades into a normally extended position extending away from said headpiece.

* * * * *